United States Patent [19]

Lautenberger et al.

[11] Patent Number: 4,761,150

[45] Date of Patent: Aug. 2, 1988

[54] MOVING EYE FOR DOLLS

[75] Inventors: Carl Lautenberger, Lakehurst; Harvey W. Samo, Maplewood, both of N.J.

[73] Assignee: Hong Kong Yung Hong Trading Co., Ltd, Hong Kong

[21] Appl. No.: 927,488

[22] Filed: Nov. 6, 1986

[51] Int. Cl.[4] ..... A63H 3/40

[52] U.S. Cl. ..... 446/345

[58] Field of Search ..... 446/330, 337, 339, 340, 446/341, 343, 345, 346, 348, 349, 352, 392

[56] References Cited

U.S. PATENT DOCUMENTS

| | | | |
|---|---|---|---|
| 1,760,318 | 5/1930 | Poore | 446/341 |
| 2,022,286 | 11/1935 | Henry | 446/341 |
| 2,828,581 | 4/1958 | Prupis | 446/393 |
| 2,854,788 | 10/1958 | Baggott | 446/342 |
| 2,904,928 | 9/1959 | Bashover | 446/342 |
| 3,432,963 | 3/1969 | Brudney | 446/346 |
| 3,616,572 | 11/1971 | Kosicki et al. | 446/346 |
| 3,618,257 | 11/1971 | Leibowitz et al. | 446/346 |

*Primary Examiner*—Robert A. Hafer
*Assistant Examiner*—Michael Brown
*Attorney, Agent, or Firm*—Blum, Kaplan, Friedman, Silberman & Beran

[57] ABSTRACT

A movable eye for toys, dolls, and the like, has an eye component which is pivoted in an eye enclosure for motion between an open and a closed position. An actuator arm engages external surface portions of the eye component for imparting closing an opening motions thereto and for holding the eye component in closed and open positions. The actuator can be manually or mechanically actuated.

25 Claims, 5 Drawing Sheets

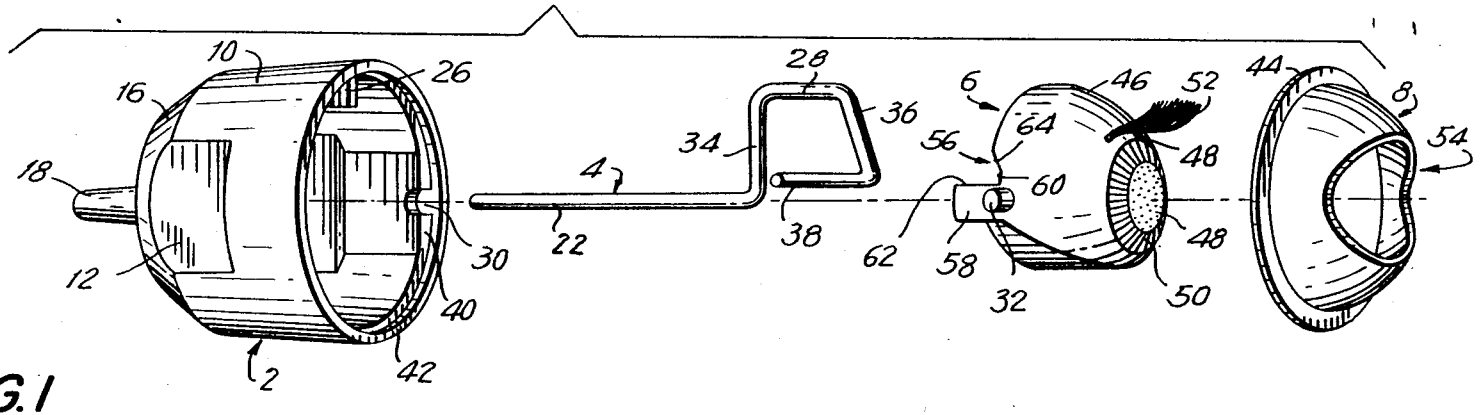
FIG. 1
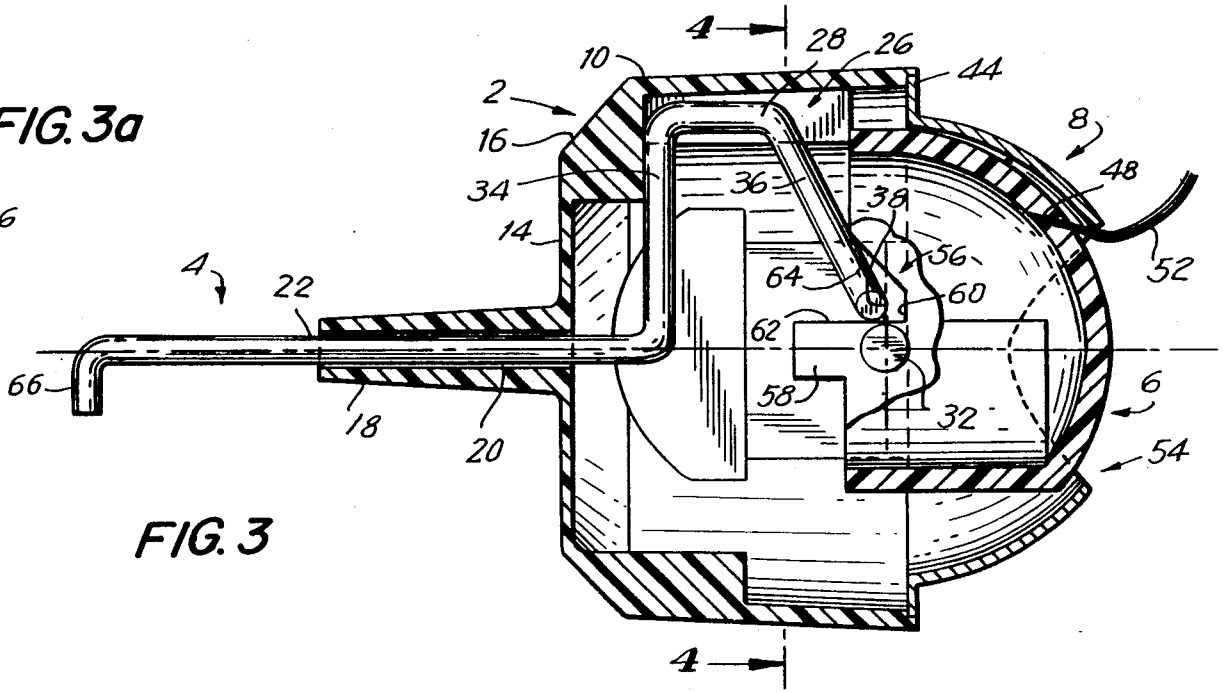
FIG. 3
FIG. 3a
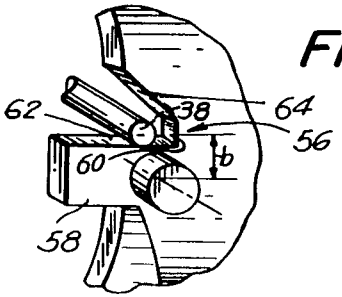

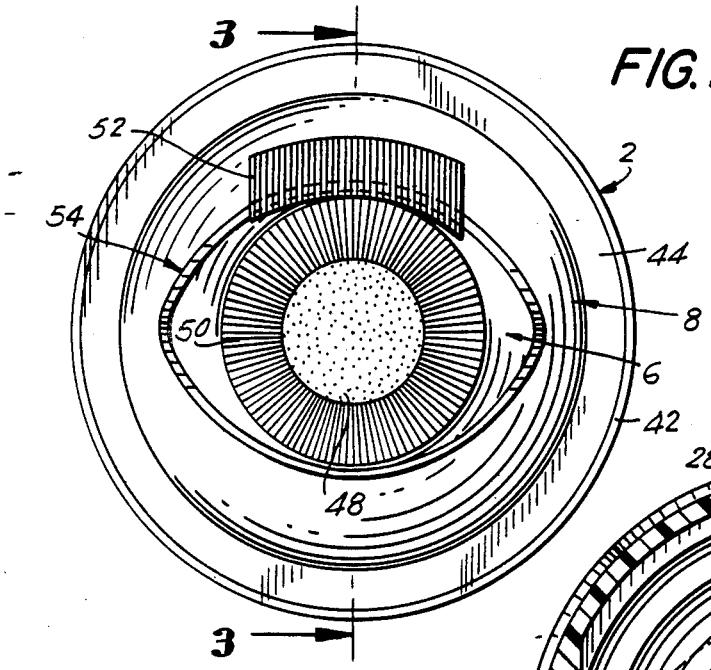
FIG. 2
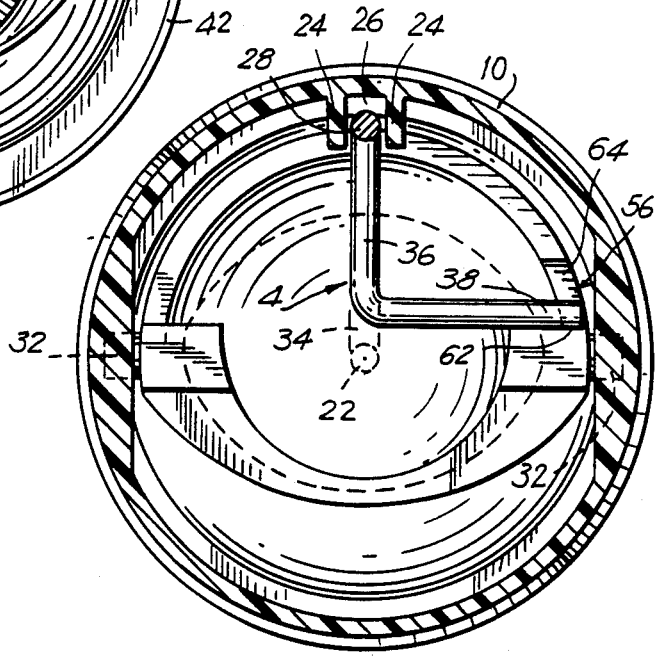
FIG. 4
FIG. 5
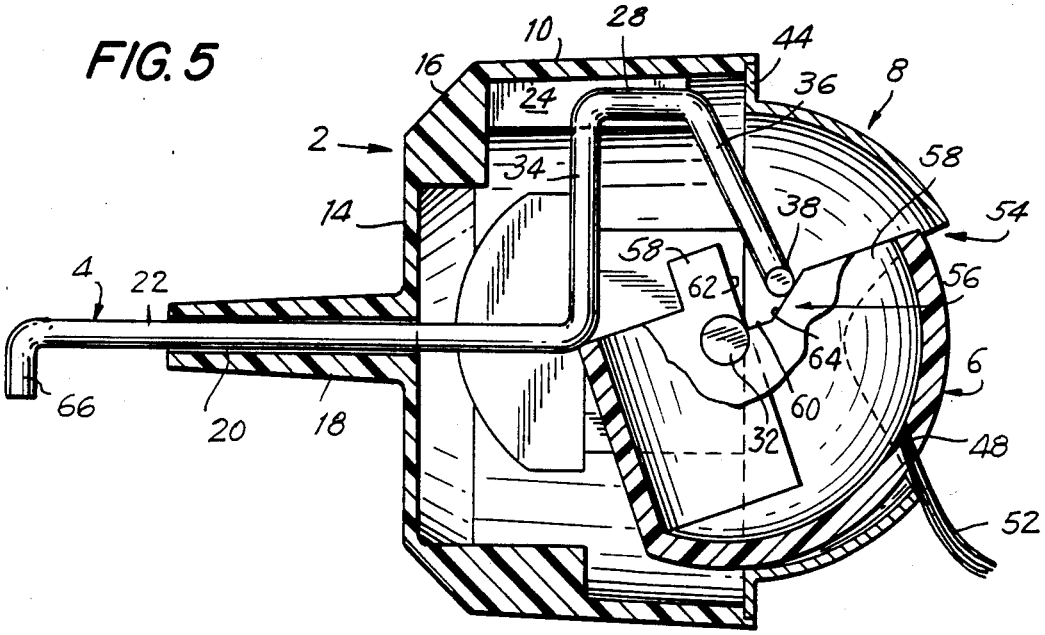

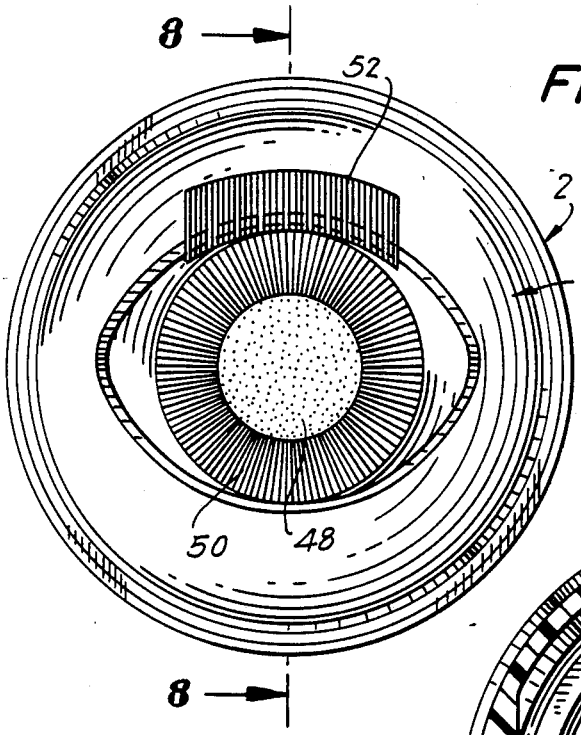
FIG. 7
FIG. 9
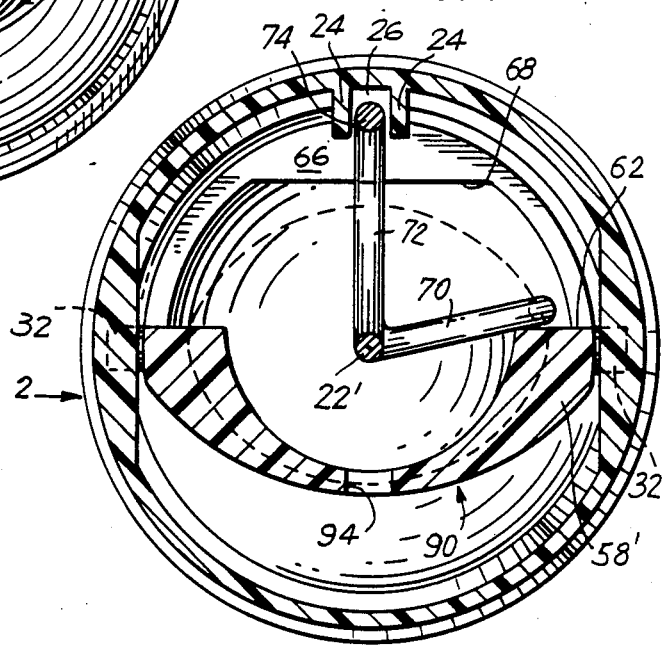
FIG. 10
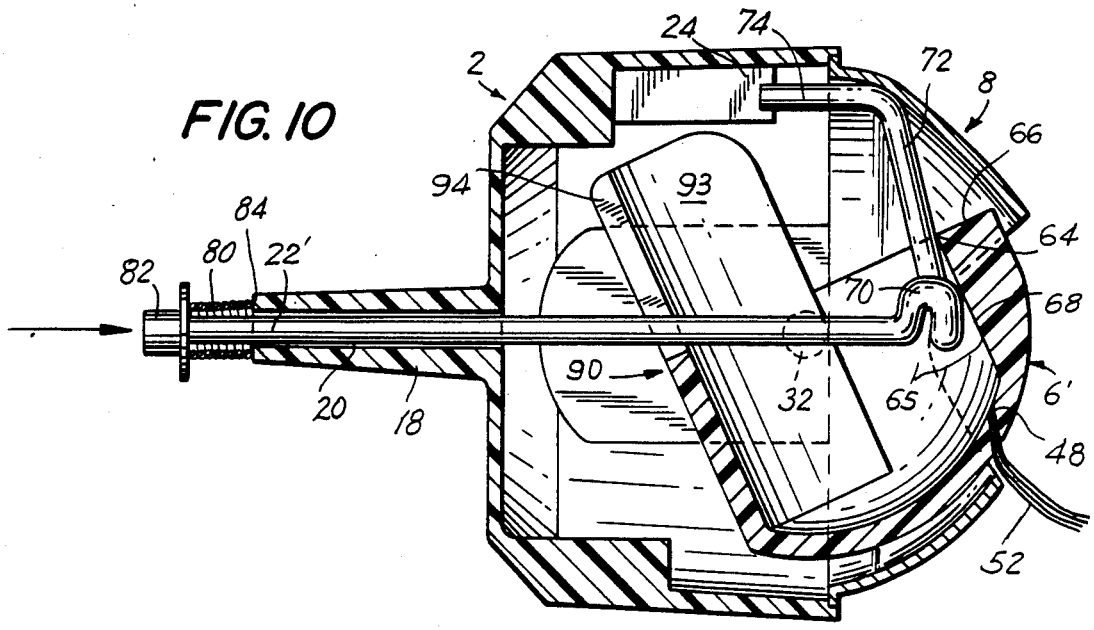

MOVING EYE FOR DOLLS

BACKGROUND OF THE INVENTION

The present invention relates to moving eyes for dolls. More particularly, the invention relates to moving eyes for dolls in which a simple structure can be actuated from outside of the doll's head for closing or opening a doll's eye, or the like, by the application of force, without regard for the doll's position.

It has long been known to provide dolls, toy animals, and the like with moving eyes which close or wink in response to a change in the doll's position from upright to horizontal in imitation of human sleeping behavior. In such dolls, the eyes are pivoted and weighted so as to respond to gravity when the doll's position is changed. There is a need, however, for dolls having eyes which can be closed and opened or winked independently of the doll's position. The eyes in such a doll would respond to the pressure of a finger on, for example, the back of a doll's head, or to actuation, for example, by a mechanism, in the case of a mechanically-actuated doll or robot.

SUMMARY OF THE INVENTION

Generally speaking, in accordance with the invention, an artificial eye for a doll or toy is provided which has an actuator to which force can be applied manually or by means of a mechanical or electromechanical driver to cause the eye to close and open. The eye includes a front cover and a back cover within which a moving eye component is pivotally supported. An actuator wire extends through the back cover and is guided therein for axial movement in response to the application of force. One or more forward portions of the actuator wire, e.g. the enclosed end of the wire, engages the moving eye component. The forward portion of the eye component is shaped in imitation of an eyeball and carries a reproduction of eye parts, which can include a lens, an iris, and eyelashes. Forward movement of the actuator causes the eye component to rotate behind the front cover so that the eye parts pass from a visible position behind an opening in the front cover through which they may be seen, to a position where the pupil and iris are concealed, and the eyelashes rest at the bottom of the aperture. A realistic representation of an eye, whether open, closed, or in between, is thus provided.

In the embodiments illustrated herein, the actuator of the doll's eye takes the form of a wire which is supported for axial movement, relative to the lens of the upper eye, through the back cover. The wire extends outside of the eye enclosure, where it can be actuated, and within the enclosure includes an off-axis portion which travels in a longitudinal guide slot, formed as part of the cover, to prevent rotation of the wire about its own axis, and a laterally extending actuator arm portion whose tip contacts external portions of the eye component to convey motion thereto.

In one embodiment of the invention the tip of the actuator arm contacts the cam surfaces of a rearward-facing notch in a side wall of the eye component. When the eye component is in the open position, the notch is located a short distance above the axis of rotation of the eye component and the actuator arm rests to the rear of the axis of rotation on a horizontal surface which extends out of the notch, keeping the eye component in the open position. When the actuator is moved forward, the actuator comes into contact with a vertical surface in the notch, and, being offset from the axis of rotation of the eye component, causes forward rotation of the eye component. Continued forward pressure on the vertical surface and then on an angular cam surface of the notch rotates the eye component to the closed position. To open the eye, the actuator arm is moved to the rear and the actuator arm again contacts the horizontal surface of the notch, causing the eye component to rotate back to the open position. If a return spring is provided on the actuator shaft, the need to apply outside force for moving the eye component to the open position is obviated, and the eye component is thereby normally maintained in the open position.

The actuator of the invention can be moved by hand or by a separate mechanical device. Thus, finger pressure can be transmitted from a button on the end of the actuator which is positioned within a soft portion at the back of the doll's head. In mechanically actuated toys and robots, the motion of a suitable driver can readily be coupled to the rearward projecting portion of the actuator wire.

In a second embodiment of the invention, the forward portion of the actuator includes, in addition to a nearly horizontal actuator arm which contacts the horizontal surface of the eye component, a vertically oriented portion which is positioned above the line of motion of the actuator. The vertically oriented portion presses against an elevational point on the eye component so that, when the actuator is moved forward, the eye component is rotated to the closed position. In this case, in contrast to the first embodiment, the vertical actuating surface is carried on the actuator arm and the sliding, relative movement of the vertical surface and the eye component is reversed.

In a third embodiment which is similar to the first embodiment, but does not require formation of a notch in the eye component, the tip of the actuator arm and the rearward-extending surface of the eye component are elevated. The tip of the actuator arm presses against a now angularly disposed cam surface of the eye component which passes through the axis of rotation of the eye component to provide full control over closing and opening of the eye component.

It is an object of the invention, therefore, to provide means for actuating the closing and opening of a doll's eye from the outside of the doll.

It is another object of the invention to provide means for manually or mechanically actuating a moving doll's eye.

Still another object of the invention is to provide a moving doll's eye whose operation is independent of the force of gravity and requires the use of little energy.

A further object of the invention is to provide a moving doll's eye which, when closed by the application of external force, will restore itself to the open condition upon withdrawal of the force.

A still further object of the invention is the provision of a moving doll's eye in which the distinguishing features of the eye are moved downwards through a wide angle, thus providing for greater realism in the visual effect produced when the eye component is actuated.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description, taken in connection with the accompanying drawings in which:

FIG. 1 is an exploded view of a first embodiment of a winking doll's eye, fabricated in accordance with the teachings of the invention;

FIG. 2 is a front elevational view of the doll's eye of FIG. 1 in an assembled condition;

FIG. 3 is a partly sectional, elevational view taken along lines 3—3 of FIG. 2, showing the eye component in a closed position;

FIG. 3*a* is a perspective view of a portion of the eye component showing the positioning of the actuator arm of FIGS. 1 and 3 when the eye is open;

FIG. 4 is a partly sectional, elevational view taken along lines 4—4 of FIG. 3;

FIG. 5 is a partly sectional, elevational view like that of FIG. 3, but with the eye component of the doll's eye in the closed position;

FIG. 7 is a front elevational view of the doll's eye of FIG. 7, when assembled;

FIG. 9 is a partly sectional, elevational view taken along lines 9—9 of FIG. 8;

FIG. 10 is a partly sectional elevational view like that of FIG. 8, but showing the eye component of the doll's eye of FIG. 6 in a closed position;

DETAILED DESCRIPTION OF THE INVENTION

Figure 6:
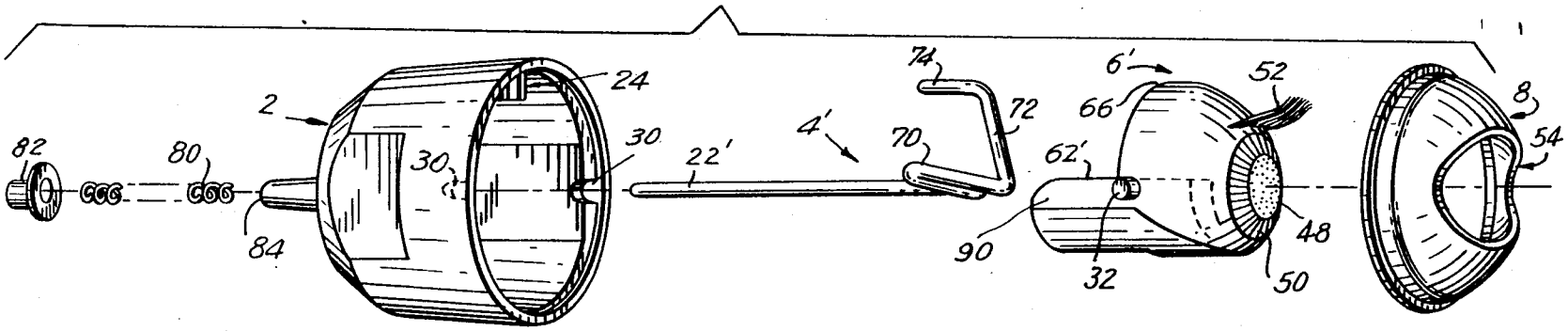
FIG. 6 is an exploded view in perspective of a second embodiment of a doll's eye and actuator, in accordance with the teachings of the invention.

Reference is now made to FIGS. 1–5 for a description of a first illustrative embodiment of the invention in which an artificial doll's eye is shown. The artificial doll's eye has a back cover 2, an actuator 4, a generally semi-spherical, hollow eye component 6, and a front cover 8 having a front opening 54 through which the eye component is displayed. When the components of the exploded view of FIG. 1 are assembled, actuator 4 and eye component 6 are held within an enclosure which is formed of back cover 2 and front cover 8, and the resulting assembly, when the eye is open, has the appearance shown in FIG. 2. In this condition, the eye component is positioned as shown in the sectional view of FIG. 3; when the eye is closed, the eye component is positioned as shown in FIG. 5. The partial sectional view of FIG. 4 shows eye component 6 from the rear, providing another view of the manner of engagement of actuator wire 4 of the first embodiment with eye component 6.

Back cover 2 is conveniently formed of molded plastic and includes a hollow, cylindrical portion 10, with external mounting flats 12 on either side. A vertical back wall portion 14 is connected to cylindrical portion 10 at a 45° chamfered surface 16. An actuator boss 18 extends outward from back wall 14 and contains an axial shaftway 20 in which shaft portion 22 of actuator 4 is coaxially received. A pair of parallel guide rails 24 (FIGS. 4, 5) is molded on the upper inside surface of back cover 2 and forms a guide slot 26 in which an off-axis portion 28 of actuator 4 is guided in longitudinal motion. Off-axis actuator portion 28 prevents rotation of actuator 4 about the axis of shaft 22, while permitting actuator 4 to move longitudinally in the enclosure. A pair of pivot recesses or cups 30 are located on opposite sides of the rim 42 of back cover 2 to receive and support a pair of laterally extending pivot pins 32 on eye component 6. A ledge 40, inside of peripheral rim 42, provides a seat for a radial flange 44 of front cover 8. The line of motion of shaft 22 of actuator 4 extends through the axis of pivots 32. Shaft 22, connector portions 34 and 36, and off-axis portion 28 all lie in a vertical plane which, therefore, includes the line of motion of shaft 22.

In the first embodiment, the wire of actuator 4 is bent into five distinct portions. Reading from the rear of the eye to the front, shaft portion 22 extends into the enclosure from the outside of back cover 2 and is then bent laterally to form off-axis connector portion 34. Rearward connector portion 34 supports forward-extending, off-axis portion 28, which lies in longitudinal guide slot 26, e.g. between guide rails 24 of back cover 2. The length of off-axis portion 28 insures engagement within guide slot 26 in either the fully extended or the fully retracted condition of actuator 4. A forward connector portion 36 of actuator wire 4 extends inward from the front end of off-axis portion 28 to a point just above the axis of actuator shaft 22, where, after a further bend in the wire, actuator 4 has an actuator arm portion 38 which lies substantially parallel to the axis of rotation of eye component 6. Thus, as depicted in FIG. 4, except for actuator arm portion 38, all of actuator 4 lies in one plane, and actuator arm 38 extends substantially perpendicular to that plane.

As previously indicated, eye component 6 is a hollow, semi-spherical shell 46, on the horizontal diameter of which laterally extending pivot pins 32 are fixed. Pivot pins 32 enable rotation of eye component 6 and its eye parts, including an iris 50, a surrounding pupil 48, and eye lashes 52, along an arcuate path behind front cover 8. When eye component 6 is in place in front cover 8, eye lashes 52, which are fastened in a slot 48 in eye component 6, project through front cover opening 54. Also, the tip of actuator arm 38 is received in a cam-like notch 56 (FIGS. 1, 3, 3*a* and 5) which is formed in one side of shell 46. When eye component 6 is in the open position, the tip of actuator arm 38 is positioned on first actuator surface 62 which extends from within notch 56 onto a rearward-extending skirt portion 58 of eye component 6. Notch 56 also provides a second actuator surface 60 which extends upward from the forward end of first actuator surface 56 and which is upright when the eye is open, and a third, upper actuator surface 64, which slopes upward and toward the rear from the top of second actuator surface 60.

Operation of the moving eye of FIGS. 1–5 is as follows. When actuator 4 is positioned fully to the rear of the assembly, the tip of actuator arm 38 is at its rearmost position, pressing downward against rearward-extending surface 62 of notch 56. When the eye is open as depicted in FIG. 3, the bottom of actuator arm 38 presses against horizontal actuator surface 62 at a point which is substantially to the rear of the axis of pivots 32 and thus serves to retain eye component 6 in the open position. When actuator 4 is moved forward, actuator arm 38 moves forward on rearward-extending surface 62 and comes against vertical actuator surface 60. As it continues forward, the tip of actuator arm 38 moves off of surface 62, while continuing to press against vertical surface 60. Eye component 6 rotates toward the closed position and actuator arm 38 moves from actuator surface 60, which is now nearly horizontal, onto sloping portion 64 (FIG. 5), completing rotation of eye component 6 to the closed position. Thus, to fully close the eye, the tip of actuator arm 4 is moved onto sloping portion 64. To open the eye, the force applied to actuator shaft 22 is reversed, causing actuator arm 38 to travel back across the three surfaces of notch 56, e.g. from the third slanting actuator surface 64 to the second actuator surface 62, and thence to first actuator surface 62, bringing eye component 6 to the open position FIG. 3. Using the construction of the foregoing embodiment, a 60° movement of the eye component can be attained with a small movement of actuator 4.

The outer end of actuator shaft 22, which is shown as straight in FIG. 1, can be bent downwards, as shown at 66 in FIGS. 3 and 5, to provide a seat for a finger-actuating button or pressure pad, or a purchase for coupling to a solenoid or to the mechanical actuating device of a robot. In the alternative, as shown in the embodiment of FIGS. 6–10 and described below, a coil spring can be mounted on the outer portion of the shaft for the purpose of providing a return force when the actuating force is withdrawn.

A second embodiment of the invention is illustrated in FIGS. 6–10. In these figures, the same numbers are given to those elements which perform like functions as the elements in FIGS. 1–5. Thus, the moving eye of FIG. 6 includes a back cover 2, a front cover 8, an actuator 4' and an eye component 6'. As with the first embodiment, shaft 22' of actuator 4' of the second embodiment is supported in a rearward-extending boss 18 on back cover 2, and eye component 6 is provided with a pair of laterally-extending pivots 32 which are rotatably received in a pair of pivot recesses 30 formed in back cover 2. Eye component 6' is shell-like, as was eye component 6 of FIG. 1, has a rearward-extending side portion 58, and is provided with eye parts, including a pupil 48, a surrounding iris 50, and eyelashes 52. When the eye component is in the open position behind cover 8, the eye parts, as well as a portion of the surface of eye component 6' which surrounds iris 50, are visible through front cover opening 54. A pair of guide rails 24, molded onto the inside of the upper portion of back cover 2, provide a guide slot 26 for an off-axis portion 74 of actuator 4' which prevents rotation of the actuator about the axis of actuator shaft 22.

Like eye component 6 of FIGS. 1–5, eye component 6' of FIGS. 6–10 is provided with an actuator surface 62' which, when the eye is open, extends horizontally to the rear of the eye component 6, being offset from the axis of pivots 32. Actuator surface 62' responds to pressure from actuator 4', when moved into rearward positions, to restore and maintain eye component 6' in the open position. The sliding surface which translates movement of actuator 4' into rotation of eye component 6' towards the closed position is carried on the actuator arm instead of on the eye component. Differing from the first embodiment, a corner or pivot point 64 is formed at the intersection of the upper rear surface 66 of eye component 6' with the upper inner surface 68 of the eye component, above and somewhat to the rear of the axis of pivot 32. Pivot point 64 serves as an actuating point to which actuator 4', as will be seen, applies force for moving eye component 6' to the open position.

Figure 8:
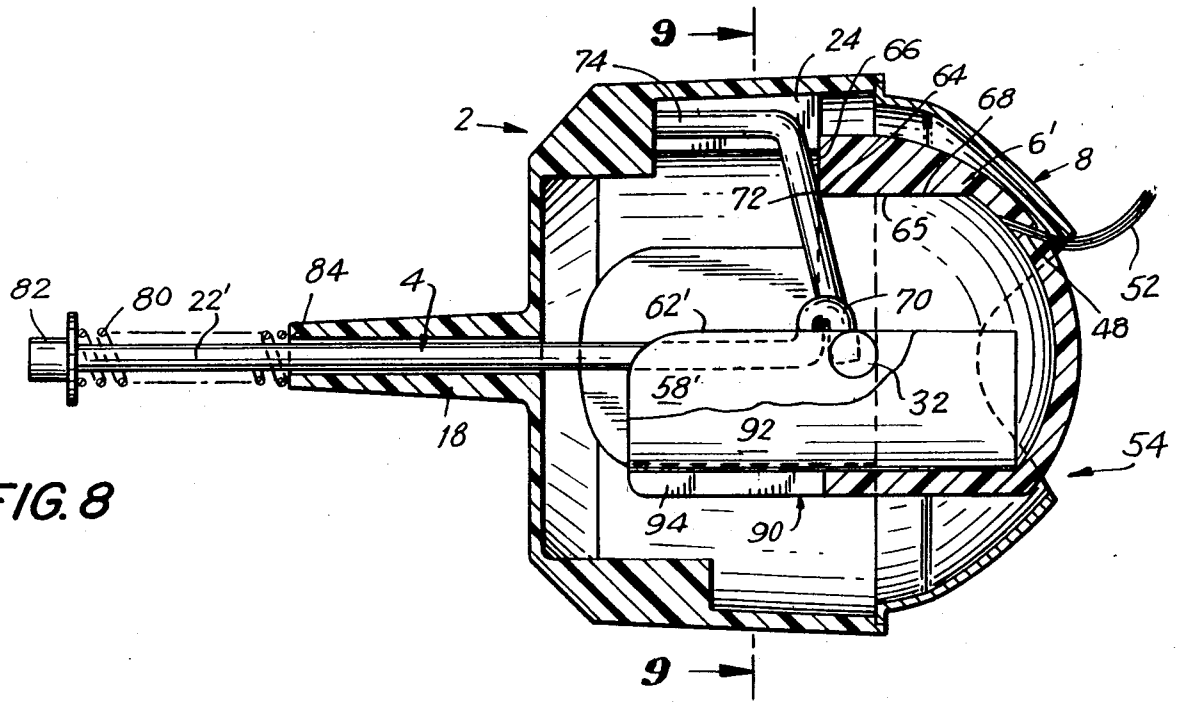
FIG. 8 is a partly sectional elevational view of the assembled doll's eye taken along lines 8—8 of FIG. 7, showing the eye component in the closed position.

Actuator 4' of FIGS. 6–10 has a different configuration than the actuator 4 of the first embodiment. Thus, shaft 22' extends further to the front; there it is bent laterally and slightly upwards, relative to the axis of shaft 22', being then reversed to form a loop or hairpin-like actuator arm 70. As depicted in FIGS. 8 and 9, actuator arm 70 is located on shaft portion 22', when actuator 4' is in the withdrawn position, so as to rest on the edge of horizontal actuating surface 62' at a point behind the axis of pivots 32. Eye component 6' is thus maintained in the open position.

The return loop of actuator arm 70 extends to the axis of actuator shaft 22 and is there bent upwards to provide an actuator surface 72 slanted somewhat to the rear and lying in the plane of guide slot 26 and the axis of shaft 22', as shown in FIGS. 8 and 10. At the level of guide slot 26, the wire of actuator 4' is bent to the rear to provide a horizontal, off-axis portion 75 which engages in slot 26 to prevent rotation of actuator 4' on actuator shaft 22'. Rearward-sloping portion 72 of actuator 4' presses, when actuator 4' is moved forward, against corner 64 to rotate eye component 6' toward the closed position. At the same time, the elevated tip of actuator arm 70 slides forward on horizontal surface 62, past the axis of pivots 32, releasing eye component 6' for rotation. When actuator 4' is fully forward, the eye component attains the position shown in FIG. 10.

To move eye component 6' to the open position, actuator 4' is moved to the rear by the application of a suitable force to the external portion of shaft 22', removing pressure of sloping actuator portion 72 on pivot point 64 of eye component 6' to permit rotation of the eye component to the rear. As actuator arm 4' moves to the rear, actuator arm 70 engages actuator surface 62', causing eye component 6' to rotate toward the closed position. Continued motion of actuator 4' brings the eye component to the open position shown in FIG. 8 where it is held by pressure of actuator arm 70 on surface 62.

As illustrated in FIGS. 6, 8 and 10, the shaft 22' (or shaft 22 of FIG. 1) may be surrounded, where it projects from actuator support boss 18, by a compressible coil spring 80. One end of coil spring 80 abuts rear surface 84 of boss 18 and the other end rests on the radial flange of a cap 82 which is interference-fitted onto the end of actuator shaft 22'. Energy which is stored by compression of coil spring 80 when actuator shaft 22' is moved to close the eye, is released when forward pressure on the shaft is removed, urging actuator 4' to the rear, returning eye component 6' to the open position.

In the embodiment of FIGS. 6–10, a counterbalancing weight portion of eye component 6' extends from the bottom of the eye component. As depicted in FIG. 8, counterbalance weight 90 extends horizontally to the rear when the eye component is open. As depicted in FIG. 8, side wall 92 of counterbalance weight 90 is bounded at the top by horizontal surface 62'. As best seen in FIGS. 8, 9, and 10, a longitudinal slot 94 in the bottom of counterbalance weight 90 receives actuator 22' when, as depicted in FIG. 10, eye component 6' is in the closed position. The counterbalance arrangement shown in FIGS. 6–10 can be employed with any of the embodiments of the present invention to prevent sagging of the eye toward the closed position when the doll is in a vertical position, and is particularly desirable when no spring is provided for maintaining the actuator in the rearward, open position.

Figure 11:
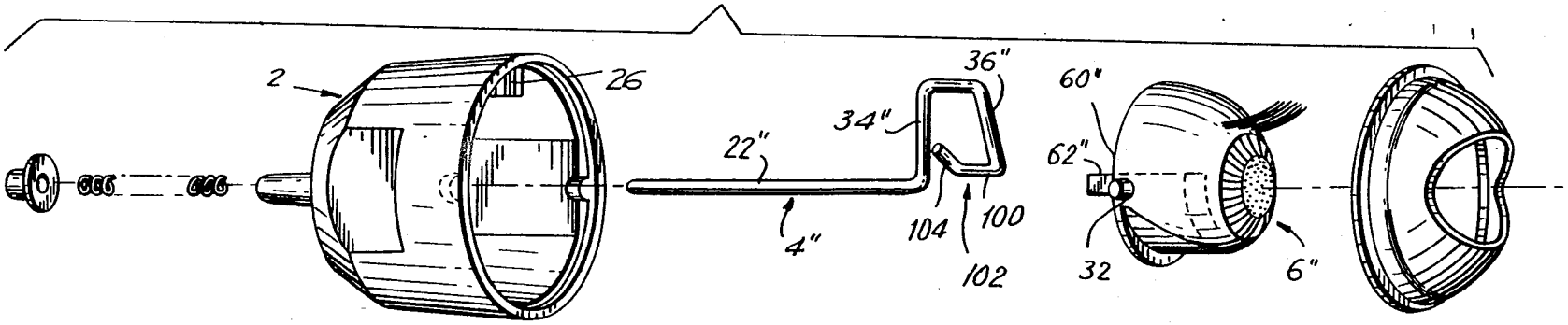
FIG. 11 is an exploded view in perspective of a third embodiment of a doll's eye and actuator, in accordance with the teachings of the invention.
Figure 12:
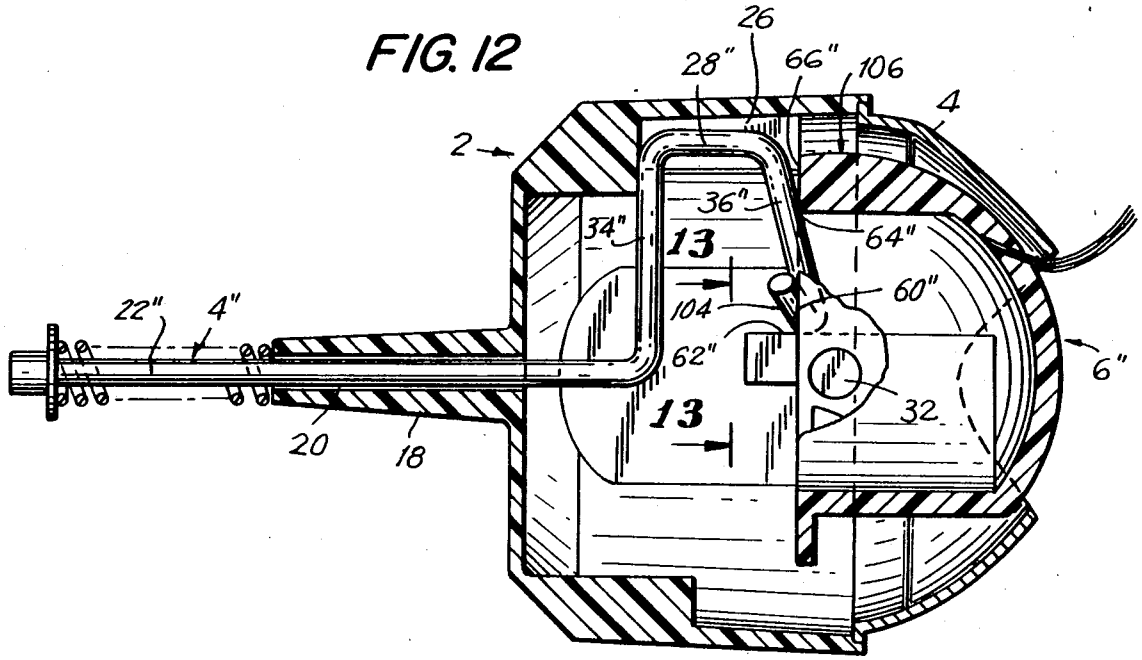
FIG. 12 is a partly sectional, elevational view of the doll's eye of FIG. 11 in an assembled condition, with the eye open.
Figure 13:
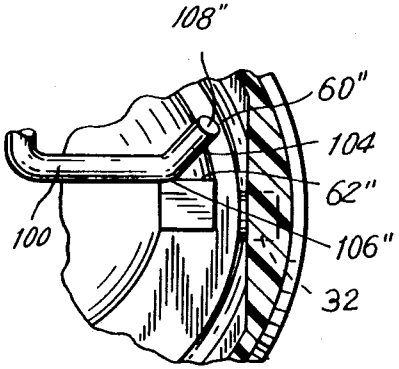
FIG. 13 is a partly sectional, rear elevational view taken along lines 13—13 of the doll's eye of FIG. 12.

In the third embodiment of the invention, illustrated in FIGS. 11–13, actuator 4'' includes an actuator shaft portion 22'', an off-axis connector portion 34'', an off-axis portion 28'' which is received in longitudinal guide slot 26 of back cover 2, a forward connector portion 36'' which extends downward and slightly forward of the vertical to substantially transverse portion 100 of actuator arm 102. A tip portion 104 extends upward and to the rear from horizontal actuator arm portion 100, and rests, as shown in FIGS. 12 and 13, in the intersection of rearward extending surface 62'' and vertical surface 60'' of eye component 6''. Thus, shaft 22'', off-axis connector portions 34'' and 36'' and off-axis portion 28'' all lie in a plane which passes through guide slot 26 and the longitudinal axis of the eye assembly which is defined by passageway 20 in rearward-extending boss 18. As depicted in FIG. 12, first rearward-extending actuator surface 62'' is positioned above the axis of pivots 32 and second, vertical actuator surface 60'' is located by a similar distance to the rear of the axis of pivot 32 so as to reduce the amount of force which must be applied for rotating the eye component to these surfaces by actuator arm 102. Therefore, the basic, hemispherical eye component 6'' includes a skirt portion 106 which extends rearward of the eye component; vertical surface 60'' is a portion of the rearward surface thereof.

When the eye is in the open position, the corner 64'' which is formed at the top of eye component 6'' by the intersection of horizontal surface 64'' with vertical surface 66'', rests against forward connector portion 36'' of actuator 4'' and prevents rearward rotation of the eye component beyond the desired position when the eye is open. At the same time, as depicted in FIG. 13, the tip 104 of actuator arm 102 is in contact with both horizontal actuator surface 62'' and vertical actuator surface 60''. Also, the lower surface 106'' of upward and rearward extending portion 104 of actuator arm 102 contacts the edge of horizontal actuator surface 62'' and the forward surface 108'' of actuator tip portion 104 is in contact with vertical actuator surface 60''. When eye component 6'' is to be moved to the closed position, pressure is exerted by forward surface 108'' of actuator arm 102, and, being delivered at a substantial distance off of the line of action of shaft 22 which extends through the axis of pivots 32, forces eye component 6 to rotate, closing the eye. When eye component 6'' is in the closed position, therefore, surface 106'' is no longer in contact with horizontal actuator surface 62''. When the eye is to be opened, rearward motion of actuator 4'' brings surface 106'' of actuator arm 102 back into contact with horizontal surface 62'' and eye component 6'' is rotated back to the open position.

It will thus be seen that the objects set forth above, among those made apparent from the preceding description, are efficiently attained and, since certain changes may be made in the above articles without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A movable eye for a doll, comprising:

eye enclosure means having a viewing aperture;

eye component means carrying a representation of an eye, the eye component means being pivotably supported in the eye enclosure means and being rotatable therein between a closed position and an open position at which the representation of the eye is visible through the viewing aperture, the eye component means including a notch having a first actuating cam surface and a second actuating cam surface; and actuator means supported by the enclosure means for movement towards and away from the eye component means, said actuator means having a forward end positioned in said notch in said eye component means, motion of the actuator means selectively contacting the first actuating cam surface and the second actuating cam surface so that, when the actuator means forward end is urged towards the eye component means and contacts said second actuating cam surface, the eye component means is rotated towards the closed position, and when the actuator means forward end is urged away from the eye component means and contacts said first actuating cam surface, the eye component means is rotated towards the open position.

2. The movable eye of claim 1, and further comprising:

guide means at the rear of the enclosure means in which the actuator means is supported for movement towards and away from the eye component means.

3. The movable eye of claim 1, wherein motion of the actuator means causes said forward end to contact said second actuating cam surface which is substantially vertical when the eye component means is in the open position and which causes the eye component means to rotate towards the closed position.

4. The movable eye of claim 1, wherein the first actuating cam surface is substantially vertical when the eye component means is in the closed position and contacts the forward end of the actuator means when moved away from the eye component means to rotate the eye component means towards the open position.

5. The movable eye of claim 1, wherein when the eye component means is in the open position, the first actuating cam surface extends substantially horizontally to the rear of the axis on which the eye component means is pivotably supported and the forward end of the actuator means rests thereon to prevent rotation of the eye component means to the closed position.

6. The movable eye of claim 1, wherein motion of the actuator means away from said eye component means causes the forward end to contact said first actuating cam surface which is substantially vertical when the eye component means is in the closed position, the first actuating cam surface contacting the forward end of the actuator means to rotate the eye component means towards the open position, and wherein the second actuating cam surface is substantially vertical when the eye component means is in the open position and contacts the forward end of the actuator means to rotate the eye component means towards the closed position.

7. The movable eye of claim 1 wherein at least a portion of the eye component means comprises a hemispherical shape which carries the representation of the eye.

8. The movable eye of claim 7 in which the eye enclosure means has a diameter on which the eye component means is pivoted, and in which the plane of the first actuating cam surface is offset from the axis of rotation of the eye component means.

9. The movable eye of claim 6 wherein the first and the second actuating cam surfaces comprises surfaces of the notch in the eye component means which is proximate to the axis upon which the eye component means is pivoted.

10. The movable eye of claim 9 wherein the hemispherical shape further comprises a portion extending rearward of the axis of rotation, the first actuating cam surface being on the rearward portion.

11. The movable eye of claim 9 in which the notch is located offset from the path of movement of the actuator means and wherein the forward end of the actuator means comprises a generally laterally extending arm which contacts the surfaces of the notch.

12. The movable eye of claim 9 and further comprising:

a third actuating surface in the notch, the third actuating surface extending upward from, and to the rear of, the second actuating cam surface, the actuator means contacting the third actuating surface after contacting the second actuating surface to accelerate rotation of the eye component means to the closed position.

13. The movable eye of claim 2 wherein the actuator means comprises a wire member having an actuator arm for contacting at least the first actuating cam surface.

14. The movable eye of claim 2 and further comprising:

guide means supported by the enclosure means; and off-axis means on the actuator means, the off-axis means travelling in the guide means so as to prevent rotation of the actuator means during movement towards and away from the eye component means.

15. The movable eye of claim 13 wherein the first actuating cam surface comprises a vertical actuating surface and the second actuating surface comprises a horizontal actuating surface, and the actuator arm contacts both actuating surfaces.

16. The movable eye of claim 1 wherein the eye component means comprises a pressure point and the actuator arm comprises:

a substantially upright portion for contacting the pressure point.

17. The movable eye of claim 16 wherein the actuating means comprises a wire which is bent at the forward end to provide an actuating arm which contacts the first actuating surface.

18. The movable eye of claim 17 and further comprising:

guide means on the enclosure means lying parallel to the direction of movement of the actuator movement; and off-axis means carried on the actuator means and movable in the guide means to prevent rotation of the actuator means, the off-axis means comprising a portion of the wire of the actuator means.

19. The movable eye of claim 18 wherein the off-axis means comprises a rearward extension of the upright portion of the actuator means.

20. The movable eye of claim 1 wherein a portion of the actuator means extends externally of the eye enclosure means, and further comprising:

means on the external portion for coupling motion thereto.

21. The movable eye of claim 1 wherein the actuator means extends externally of the eye enclosure means, and further comprising:

resilient means coupled between the external portion and the eye enclosure means for maintaining the eye in an open position when the actuator means is not actuated.

22. The movable eye of claim 6 wherein the eye component means is supported in the enclosure means by pivots and wherein the first and the second actuating cam surfaces are respectively located to the rear and above the axis of the pivots.

23. The movable eye of claim 22 wherein the actuator arm comprises a tip which contacts both of the first and second actuating cam surfaces when the eye component means is in the open position.

24. The movable eye of claim 22 wherein the eye component means comprises a point of contact above the axis of the pivots and the actuator arm makes contact therewith when the eye component is in the open position to prevent rearward rotation of the eye component means.

25. The movable eye of claim 23 wherein the actuator arm comprises a horizontal portion, and a tip portion which extends upwards and rearwards from the horizontal portion.

* * * * *